United States Patent [19]

Higashiguchi et al.

[11] Patent Number: 5,049,471

[45] Date of Patent: Sep. 17, 1991

[54] MAGNETIC BRUSH DEVELOPMENT PROCESS

[75] Inventors: Teruaki Higashiguchi; Junko Mizuno, both of Tokyo, Japan

[73] Assignee: Mita Industrial Co., Ltd., Osaka, Japan

[21] Appl. No.: 442,186

[22] Filed: Nov. 28, 1989

[30] Foreign Application Priority Data

Nov. 28, 1988 [JP] Japan ..... 63-298384

[51] Int. Cl.[5] ..... G03G 15/09

[52] U.S. Cl. ..... 430/122; 355/251

[58] Field of Search ..... 430/122; 355/251, 253; 118/657, 658

[56] References Cited

U.S. PATENT DOCUMENTS 4,637,973 1/1987 Shigeta et al. ..... 430/122

4,949,127 8/1990 Matsuda et al. ..... 430/122

*Primary Examiner*—John Goodrow

*Attorney, Agent, or Firm*—Sherman and Shalloway

[57] ABSTRACT

An optimum image can be obtained by carrying out the development while using a two-component type developer comprising an electroscopic toner and a magnetic carrier and maintaining the peripheral speed ratio of the magnet sleeve to the photosensitive material drum within a certain range according to the average particle size and saturation magnetization of the magnetic carrier.

11 Claims, 2 Drawing Sheets

MAGNETIC BRUSH DEVELOPMENT PROCESS

BACKGROUND OF THE INVENTION (1) Field of the Invention

The present invention relates to a magnetic brush development process using a so-called two-component type developer in the electrophotography.

(2) Description of the Prior Art

In the electrostatic photography, there has been widely adopted a magnetic brush development process comprising supplying a two-component type developer comprising an electroscopic toner and a magnetic carrier onto a magnet sleeve to form a magnetic brush, and bringing the magnetic brush into sliding contact with the surface of a photosensitive material drum on which an electrostatic latent image is formed, to visualize the latent image and form a toner image.

In this magnetic brush development process, however, not only characteristics of the developer and photosensitive material but also various mechanical conditions such as the peripheral speed of the photosensitive drum, the peripheral speed of the magnet sleeve, the drum-sleeve distance, the magnetic intensity of the magnet sleeve and the cutting length of the magnetic brush are important as factors for obtaining a good image, and setting of conditions for obtaining an optimum image is very difficult and complicated.

By the optimum image is meant an image having a good image density and a good resolution. However, in general, the conditions for obtaining an image having a high image density are not in agreement with the conditions for obtaining an image having a high resolution, and it is very difficult to set the development conditions.

Recently, high-speed reproduction is eagerly desired, and if the rotation speed of the photosensitive material drum is much increased over the speed adopted in the conventional electrostatic photographic apparatus, other development conditions should be drastically changed and the above-mentioned disadvantage becomes more serious.

Furthermore, even if development conditions capable of providing a good image are set at the initial stage, when the developer or sleeve is deteriorated by the continuous reproduction for obtaining many prints, the agitating property and flowability of the developer, especially the brush-forming property, are changed and it becomes difficult to form an optimum magnetic brush, with the result that reduction of the image quality often takes place. This is especially conspicuous under high-temperature high-humidity undesirable conditions.

SUMMARY OF THE INVENTION

The present invention is to obtain an image having a high image density and a good resolution by setting the ratio of the peripheral speed of the magnet sleeve to the peripheral speed of the photosensitive material drum within a certain range according to the average particle size and saturation magnetization of the magnetic carrier used for the two-component type developer and the dynamic friction coefficient of the magnetic brush.

More specifically, in accordance with the present invention, there is provided a magnetic brush development process in the electrophotography, which comprises supplying a two-component type developer comprising an electroscopic toner and a magnetic carrier onto a magnet sleeve to form a magnetic brush and bringing the magnetic brush into sliding contact with the surface of a photosensitive material drum on which an electrostatic latent image is formed, to effect development, wherein the development is carried out under such conditions that the peripheral speed ratio K of the magnet sleeve to the photosensitive material drum satisfies the following requirement:

$$\frac{1.25\,d}{x} \leqq K \leqq \frac{2\,d}{x} \qquad (1)$$

wherein d represents the average particle size (μm) of the magnetic carrier of the developer, and x represents the saturation magnetization (emu/g) of the magnetic carrier of the developer.

In the present invention, it is preferred that a toner composition formed by adding a fine powder of an acrylic polymer and a fine powder of silica to an electroscopic toner be used as the electroscopic toner. It also is preferred that a magnetic carrier having an apparent density of 2.4 to 3.0 g/cm$^3$ be used.

Furthermore, it is preferred that the magnetic carrier used should have such a particle size distribution that the amount of particles having a particle size up to 0.5 time as large as the average particle size is smaller than 0.1% by weight and the amount of particles having a particle size 0.7 to 1.4 times as large as the average particle size is at least 90% by weight.

A magnetic carrier covered with a resin is preferably used as the magnetic carrier.

DETAILED DESCRIPTION OF THE PREFERRED EMBODIMENTS

Figure 1:
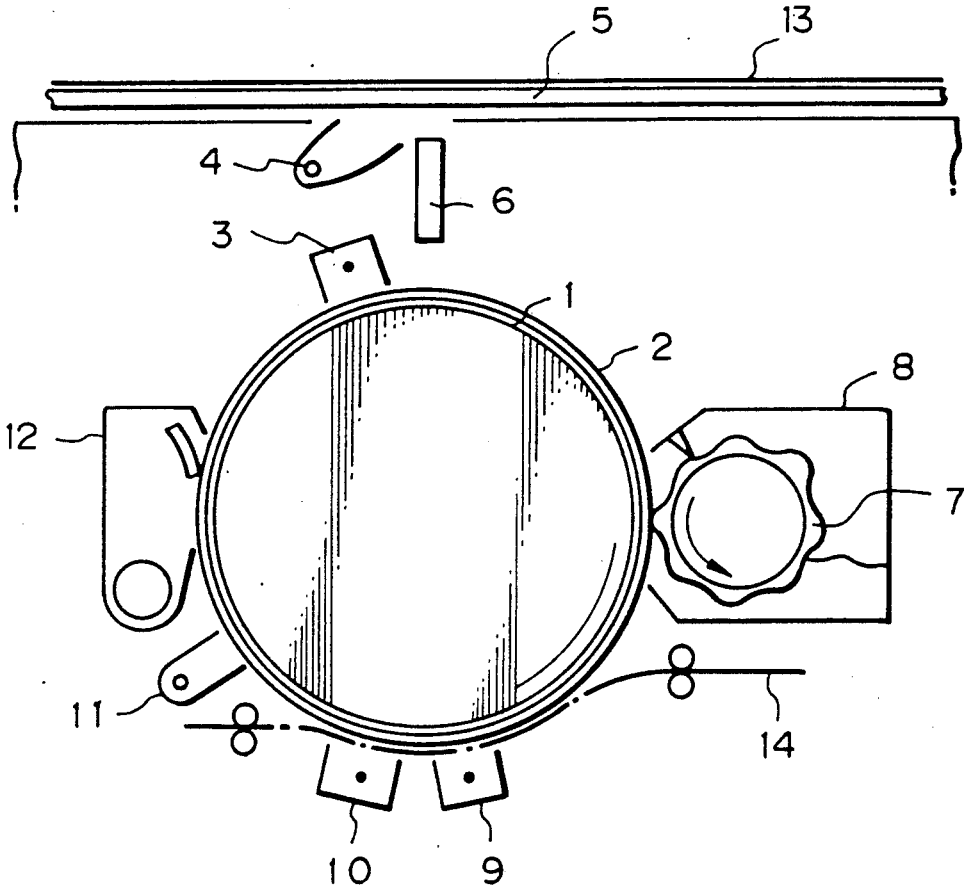
FIG. 1 is a diagram illustrating an electrostatic photographic apparatus suitable for use in carrying out the development process of the present invention.

The present invention is based on the novel finding that in the magnetic brush development process using a two-component type developer, the mechanical development conditions for obtaining an optimum image depend greatly on the peripheral speed ratio of a magnetic brush-delivering magnet sleeve to a photosensitive material drum and this peripheral speed ratio is appropriately set according to the particle size μm) and saturation magnetization (emu/g) of the magnetic carrier used.

For example, if the above-mentioned peripheral speed ratio K is higher than 2d/x, the obtained image is poor in the resolution, and if the peripheral speed ratio K is lower than 1.25d/x, the density of the image is low though the resolution is satisfactory.

The above-mentioned formula (1) defining the development conditions is one empirically obtained, and the reason why an optimum image is obtained by carrying out the development under conditions satisfying the requirement of this formula (1) has not been elucidated, but it is presumed that this effect will probably be attained for the following reason.

In order to obtain an optimum image, it is considered necessary that the electric resistance value of the magnetic brush in the development zone should be within a certain range, and it is considered that the electric resistance value is expressed by the function of the average particle size and saturation magnetization of the magnetic carrier, and the peripheral speed ratio of the magnet sleeve to the photosensitive material drum.

For example, under development conditions satisfying the requirement of formula (1), an appropriate electric resistance value is maintained, and as the result, an optimum image can be obtained.

More specifically, the above-mentioned peripheral speed ratio K is higher than 2d/x, the electric resistance value of the magnetic brush is small and the resolution is reduced though the image density is increased. If the peripheral speed ratio K is lower than 1.25d/x, the electric resistance value is large and the image density is reduced though the resolution is good.

In accordance with one preferred embodiment of the present invention, a specific toner composition formed by externally adding a fine powder of an acrylic polymer and a fine powder of silica to a toner is used. In order to obtain images having a high quality stably for a long time, it is important that the state of formation of a magnetic brush which passes through a set developing zone should not be changed. If this specific toner composition is used, the dispersibility and transportability of the developer on the sleeve are improved and a uniform magnetic brush can be formed repeatedly, and furthermore, the dispersibility of the toner in the magnetic brush is uniformalized. Accordingly, the electric resistance is always kept stable in the dynamic state of the magnetic brush and the toner moves evenly to the latent image, with the result that images having a high quality can be formed repeatedly over a long period.

In another embodiment of the present invention, in order to satisfy the requirement of formula (1) for a long time, it is important that the apparent density of the magnetic carrier used should be 2.4 to 3.0 g/cm$^3$.

In order to satisfy the requirement of formula 1) over a long period, it is necessary that the electric resistance value of the magnetic brush should always be stably maintained within a certain range, and if the apparent density of the magnetic carrier is set within the above-mentioned range, it becomes possible to set the electric resistance value of the magnetic brush within a certain range for a long time, and good images can be stably obtained for a long time.

Accordingly, in the case where the apparent density of the magnetic carrier is outside the above-mentioned range, if formation of images is repeated for a long time, it becomes difficult to maintain the electric resistance value of the magnetic brush within the certain range, and it often happens that the requirement of formula (1) is not satisfied.

Furthermore, if the apparent density of the magnetic carrier is outside the above-mentioned range, when the developer is deteriorated by repeating formation of images for a long time, the image density becomes unstable and fogging is readily caused, and it often happens that a good image cannot be obtained.

In still another embodiment of the present invention, in order to satisfy the requirement of formula (1), it is necessary that the magnetic carrier used should have such a particle size distribution that the amount of particles having a particle size up to 0.5 time as large as the average particle size is smaller than 0.1% by weight and the amount of particles having a particle size 0.7 to 1.4 times as large as the average particle size is at least 90% by weight.

Namely, in order to satisfy the requirement of formula (1) for a long time, it is necessary that the electric resistance value of the magnetic brush should always be stable within a certain range, and by imparting the above-mentioned particle size distribution to the magnetic carrier, it becomes possible to maintain the electric resistance value of the magnetic brush within the certain range for a long period, and therefore, good image can be stably obtained for a long time.

Accordingly, in the case where the particle size distribution of the magnetic carrier fails to satisfy the above-mentioned condition, while formation of images is repeated for a long time, it becomes impossible to maintain the electric resistance value of the magnetic brush within the certain range, and it often happens that the requirement of formula (I) is not satisfied.

Furthermore, in the case where the particle size distribution of the magnetic carrier fails to satisfy the above condition, if formation of image is repeated for a long time, with deterioration of the developer, the scattering of the carrier is caused and it often becomes impossible to obtain a good image.

In the development process of the present invention, a magnetic carrier having the surface covered with a resin is preferably used.

In the magnetic brush development process using a two-component type developer, in general, a magnetic brush is formed by stirring and mixing a mixture of a toner and a carrier in the development apparatus. Accordingly, if formation of images is repeated for a long time, fusion bonding of the toner to the surface of the carrier is caused by collision between the toner and carrier in the development apparatus or collision between the development apparatus and the carrier. If the toner is fusion-bonded to the surface of the carrier, the electric resistance value of the magnetic brush is changed and the mutual relation between the electric resistance value of the carrier and the electric resistance value of the magnetic brush is disturbed, with the result that it often happens that the requirement of formula (1) is not satisfied.

Accordingly, in order to satisfy the requirement of formula (1) over a long period, it is necessary to prevent fusion bonding of the toner to the carrier, and this prevention of fusion bonding of the toner to the carrier can be easily accomplished by coating the surface of the carrier with a resin. Namely, if the surface of the carrier is coated with a resin, the requirement of formula (1) can be satisfied even if formation of images is repeated for a long time.

DEVELOPER

Any of known two-component type developers comprising an electroscopic toner and a magnetic carrier can be used in the development process of the present invention.

For example, a colored toner having an electroscopic property and a fixing property can be used as the toner. In general, this toner is composed of a granular composition having a particle size of 5 to 30 microns, which comprises a binder resin and, dispersed therein, a coloring pigment and a charge controlling agent.

As the binder resin of the toner, there can be used a thermoplastic resin, an uncured thermosetting resin and a precondensate of a thermosetting resin. As preferable examples, there can be mentioned, in order of the importance, a vinyl aromatic resin such as polystyrene, an acrylic resin, a polyvinyl acetal resin, a polyester resin, an epoxy resin, a phenolic resin, a petroleum resin and an olefin resin.

As the coloring pigment, there can be mentioned, for example, carbon black, cadmium yellow, molybdenum orange, Pyrazolone Red, Fast Violet B and Phthalocyanine Blue. These pigments can be used singly or in the form of a mixture of two or more of them.

As the charge controlling agent, for example, oil-soluble dyes such as Nigrosine Base (CI 50415), Oil Black (CI 26150) and Spiron Black, metal salts of naphthenic acid, metal soaps of fatty acids and soaps of resin acids can be used according to need.

As the fine powder of the acrylic polymer to be added to the above-mentioned toner, there can be mentioned spherical resin particle powders formed by emulsion polymerization, soap-free polymerization, dispersion polymerization and suspension polymerization, and powders obtained by pulverizing polymerization masses. It is generally preferred that the particle size of the fine powder of the acrylic polymer be 0.1 to 1 μm, especially 0.3 to 0.6 μm.

As the monomer constituting the acrylic polymer, there can be mentioned acrylic monomers represented by the following formula:

$$CH_2{=}\overset{\overset{R_3}{|}}{C}{-}CO{-}O{-}R_4 \qquad (2)$$

wherein $R_3$ represents a hydrogen atom or a lower alkyl group, and $R_4$ represents a hydrogen atom, a hydrocarbon group having up to 12 carbon atoms, a hydroxyalkyl group or a vinyl ester group, such as methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, ethyl β-hydroxyacrylate, propyl γ-hydroxyacrylate, butyl σ-hydroxyacrylate, ethyl β-hydroxymethacrylate, ethylene glycol methacrylate and tetramethylene dimethacrylate. These acrylic monomers can be used singly or in the form of a mixture of two or more of them.

Other radical-polymerizable monomer can be used together with the acrylic monomer. For example, there can be mentioned styrene type monomers such as styrene, α-methylstyrene, o-methylstyrene, p-methylstyrene, p-methoxystyrene and p-chlorostyrene, carboxylic acids having an unsaturated double bond and alkyl esters thereof such as maleic acid, crotonic acid, itaconic acid and alkyl esters thereof, olefin monomers such as ethylene, propylene and butadiene, and vinyl acetate, vinyl chloride, vinylidene chloride, vinyl pyrrolidone and vinyl naphthalene.

The fine powder of silica to be used in combination with the fine powder of the acrylic polymer is preferably a hydrophobic fine powder of silica having a primary particle size of 0.01 to 1 μm, especially 0.02 to 0.5 μm. As specific examples, there can be mentioned Aerosil R-927, Aerosil R-812 and Aerosil R-805 (supplied by Nippon Aerosil).

The fine powder of the acrylic polymer is used in an amount of 0.01 to 0.2 part by weight, preferably 0.03 to 0.1 part by weight, per 100 parts by weight of the toner, and the fine powder of silica is used in such an amount that the silica fine powder/acrylic polymer fine powder weight ratio is from 1/1 to 1/5, preferably from 1/2.5 to 1/3.5.

If the amount used of the fine powder of the acrylic polymer is outside the above-mentioned range, a magnetic brush is not stably formed on the development sleeve, resulting in reduction of the image quality. It is important that a specific amount of the fine powder of silica should be added to the fine powder of the acrylic polymer. By addition of the fine powder of silica, the transportability and dispersibility of the developer during the delivery from the agitating zone of the developing device to the sleeve and on the sleeve are improved, and the change of the state of the magnetic brush is reduced and the dynamic electric resistance of the magnetic brush is kept constant. Accordingly, optimum set development conditions can be maintained for a long time, and the number of obtainable copies can be drastically increased.

If the amount added of the fine powder of silica is too small and below the above-mentioned range, the dispersion state (present amount) of the developer on the sleeve is often uneven, and if the amount of the fine powder of silica is too large and exceeds the above-mentioned range, migration of the toner from the magnetic brush to the photosensitive material becomes difficult.

Known magnetic carriers such as triiron tetroxide, ferrite and iron powder can be used as the magnetic carrier in combination with the above-mentioned toner in the present invention.

It is preferred that the average particle size of the magnetic carrier be 20 to 200 μm, especially 40 to 130 μm, and it also is preferred that the saturation magnetization, as measured at 50 KOe, of the magnetic carrier be 30 to 70 emu/g, especially 40 to 50 emu/g.

According to one preferred embodiment of the present invention, a magnetic carrier having an apparent density of 2.4 to 3.0 g/cm$^3$ is used. According to another preferred embodiment of the present invention, a magnetic carrier having such a particle size distribution that the amount of particles having a particle size up to 0.5 time as large as the average particle is smaller than 0.1% by weight based on the entire carrier and the amount of particles having a particle size 0.7 to 1.4 times as large as the average particle size is at least 90% by weight based on the entire carrier is used.

According to still another embodiment of the present invention, the surface of the magnetic carrier is covered with a resin. If the surface of the magnetic carrier is covered with a resin, an optimum state of the magnetic brush can be produced repeatedly for a long time, and the number of obtainable copies can be drastically increased.

As the resin to be used for covering the surface of the magnetic carrier, there can be mentioned an acrylic resin, a styrene/acrylic resin, an acrylicmodified silicone resin, a silicone resin, an epoxy resin, a resin-modified phenolic resin, a formalin resin, a cellulose resin, a polyether resin, a polyvinyl butyral resin, a polyester resin, a styrene/butadiene resin, a polyurethane resin, a polyvinyl formal resin, a melamine resin, a polycarbonate resin and a fluorine resin such as a tetrafluoroethylene resin. These resins can be used singly or in the form of a mixture of two or more of them.

If a resin formed by curing and reacting a melamine resin and a thermoplastic resin having an unreacted hydroxyl group or alkoxyl group is used, the mechanical strength of the covering is further improved and the life of the carrier can be prolonged, and an optimum image can be obtained for a long time. As the thermoplastic resin having a hydroxyl group or alkoxyl group, there can be mentioned, for example, an epoxy resin, a hydroxyl or alkoxyl group-containing acrylic resin, a hydroxyl or alkoxyl group-containing styrene/acrylic resin, an acrylic-modified silicone resin, a phenoxy resin, a polyester resin a butyral resin, a formal resin, a silicone resin and a hydroxyl or alkoxy group-containing fluorine resin.

It is preferred that the covering resin be used in an amount of 0.1 to 10 parts by weight, especially 0.2 to 5 parts by weight, per 100 parts by weight of the carrier core.

In the above-mentioned toner, the toner concentration is adjusted so that the specific surface area ratio of the carrier to the toner is from 1/0.7 to 1/1.3, especially from 1/0.9 to 1/1.1.

ELECTROPHOTOGRAPHIC APPARATUS

Referring to FIG. 1 illustrating an electrophotographic apparatus suitable for use in working the magnetic brush development process of the present invention, a photoconductive layer 2 is formed on the surface of a metal drum 1 driven and rotated.

The photoconductive layer 2 is composed of, for example, Se, ZnO, CdS, amorphous silicon or a function-separated organic photoconductor.

Around the circumference of this drum, there are disposed a corona charger 3 for main charging, an imagewise light exposure mechanism comprising a lamp 4, an original-supporting transparent plate 5 and an optical system 6, a developing mechanism 8 having a developer 7, a corona charger 9 for transfer of the toner, a paper-separating corona charger 10, an electricity-removing lamp 11, and a cleaning mechanism 12 in the recited order.

The image-forming process using this electrophotographic apparatus will now be described in brief.

At first, the photoconductive layer 2 is charged with a certain polarity by the corona charger 3. Then, an original 13 to be copied is illuminated by the lamp 4 and the photoconductive layer 2 is exposed to the light image of the original through the optical system 6 to form an electrostatic latent image corresponding to the image of the original. This electrostatic latent image is visualized by the developing mechanism 8 to form a toner image. A transfer paper 14 is supplied so that the transfer paper 14 is brought into contact with the surface of the drum at the position of the charger 9 for transfer of the toner, and corona charging with the same polarity as that of the electrostatic latent image is effected from the back surface of the transfer paper 14 to transfer the toner image to the transfer paper 14. The transfer paper 14 having the toner image transferred thereon is electrostatically peeled from the drum by removal of electricity by the paper-separating corona charger 10 and is fed to a processing zone such as a fixing zone (not shown).

After the transfer of the toner image, residual charges on the photoconductive layer 2 are erased by the entire surface light exposure by the electricity-removing lamp 11, and then, the residual toner is removed by the cleaning mechanism 12.

DEVELOPMENT APPARATUS AND DEVELOPMENT PROCESS

Figure 2:
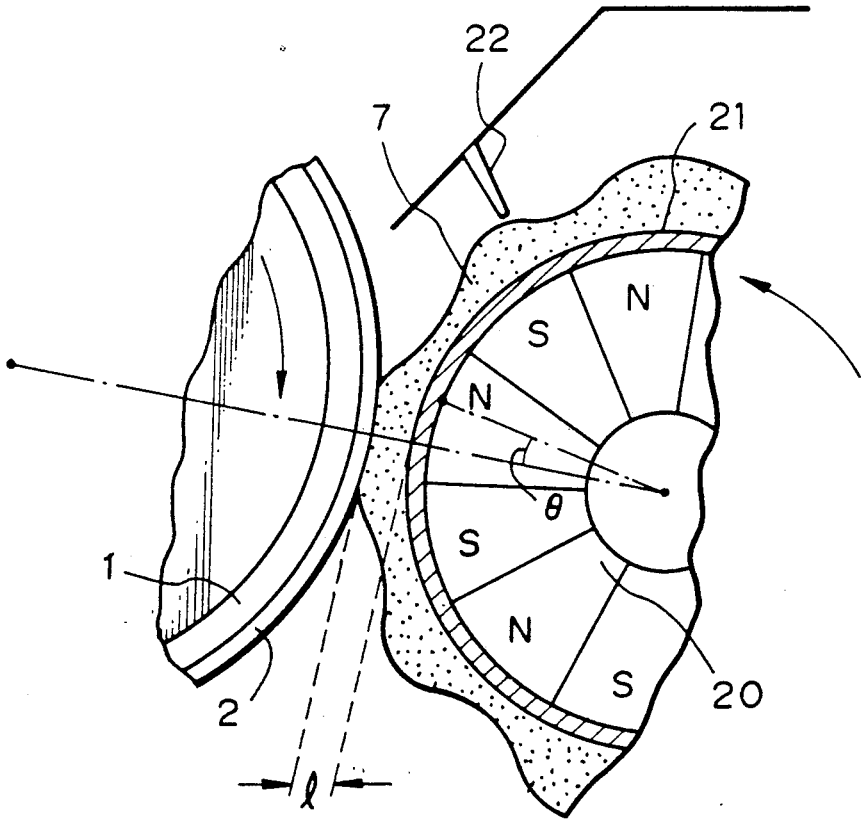
FIG. 2 is an enlarged diagram illustrating a main part of a development apparatus.

FIG. 2 is an enlarged view showing the development apparatus 8 in the above-mentioned electrophotographic apparatus.

The development apparatus 8 comprises a developer delivery sleeve 21 having a cylindrical shape, in which a magnet 20 having N poles and S poles arranged alternately is arranged.

The development process of the present invention is applied to the type where the magnet 20 is fixed and the sleeve 21 is rotated in the same direction as the rotation direction of the drum to deliver a magnetic brush 7 of the developer.

The magnetic intensity of the main pole of the magnet 20 is set at 600 to 1000 G, and the angle between the line connecting the center of the main pole and the center of the drum and the line connecting the center of the main pole and the center of the sleeve is adjusted to 0° to 10°. The distance between the photoconductive layer 2 and the sleeve 21 is adjusted to 0.8 to 1.5 mm.

A brush-cutting mechanism 22 is arranged upstream of the developing zone and the magnetic brush 7 is fed to the developing zone in the state cut into a length of 0.8 to 1.2 mm, whereby the development is carried out.

In the present invention, as pointed out hereinbefore, the development is carried out under such conditions that the peripheral speed ratio K of the sleeve to the drum 1 satisfies the requirement represented by the following formula (1):

$$\frac{1.25\,d}{x} \leqq K \leqq \frac{2\,d}{x} \qquad (1)$$

wherein d represents the average particle size (μm) of the magnetic carrier, and x represents the saturation magnetization (emu/g) of the magnetic carrier, whereby an image having a high image density and an excellent resolution can be obtained.

According to the present invention, an optimum image can be obtained only by appropriately adjusting the peripheral speed ratio between the photosensitive material drum and the magnet sleeve according to the average particle size and saturation magnetization of the magnetic carrier used for the developer.

Accordingly, optimum development conditions can be very easily set without changing mechanical conditions such as the drum-sleeve distance, the position of the magnetic pole and the brush-cutting length according to the toner used.

The present invention is especially advantageously applied to the case where the mechanical development conditions are drastically changed as in case of high-speed reproduction.

Furthermore, by using a specific toner formed by adding a combination of specific external additives to an electroscopic toner, or by using a magnetic carrier having specific physical properties and being covered with a resin, optimum images can be obtained for a long time.

The present invention will now be described in detail with reference to the following examples.

EXAMPLE 1

By using a commercially available copying machine (Model DC-112C supplied by Mita), the copying operation was carried out under developing conditions described below while changing the physical properties (particle size and saturation magnetization) of the carrier of the two-component type developer, and the image quality was evaluated.

DEVELOPMENT CONDITIONS

Cut brush length: 1.0 mm

Drum-sleeve distance 1.1 mm

Sleeve: main pole position = +3.5°, main pole intensity = 800 G

Peripheral speed of sleeve/peripheral speed of drum ratio: 2.9

Surface potential: +700 V

Bias voltage +180 V

Photosensitive material drum: selenium drum

Developer: carrier = ferrite carrier having a resistance value of $10^9\Omega$-cm, toner = toner for negative charging, having an average particle size of 11 m, the toner concentration being set so that the specific surface area ratio between the carrier and toner was 1/1

The results of the evaluation are shown in Table 1.

In the evaluation of the image quality, when ID (reflection density) of the first copy was at least 1.3 and the resolution of the second copy was at least 2.8 lines/mm in either the longitudinal direction or the lateral direction, the image quality was judged to be good and indicated by mark "O", and other case was indicated by mark "X".

From the results shown in Table 1, it is seen that a good image quality can be obtained in Runs 3 and 6 satisfying the requirement of $1.25d/x \leqq K \leqq 2k/x$.

It also is seen that when the peripheral speed ratio K is higher than 2d/x as in Runs 1, 2 and 4, the resolution is bad, and if the peripheral speed ratio K is lower than 1.25 d/x as in Run 5, ID of the obtained copy is reduced.

TABLE 1

(K = 2.9)

| Run No. | Carrier: particle size (μm) | Carrier: saturation magnetization (emu/g) | 1.25d/X | 2d/X | ID of First Copy | Resolution (lines/mm) of Second Copy, longitudinal direction | Resolution (lines/mm) of Second Copy, lateral direction | Image Quality |
|---|---|---|---|---|---|---|---|---|
| 1 | 40 | 40 | 1.25 | 2.0 | 1.47 | 2.5 | 2.5 | X |
| 2 | 40 | 65 | 0.77 | 1.23 | 1.46 | 2.5 | 2.2 | X |
| 3 | 80 | 40 | 2.5 | 4.0 | 1.31 | 3.2 | 2.8 | ○ |
| 4 | 80 | 65 | 1.54 | 2.46 | 1.42 | 2.5 | 2.5 | X |
| 5 | 130 | 40 | 4.06 | 6.5 | 1.21 | 3.2 | 3.6 | X |
| 6 | 130 | 65 | 2.5 | 4.0 | 1.32 | 3.6 | 2.8 | ○ |

EXAMPLE 2

The copying test was carried out under the same conditions as described in Example 1 by using the carrier used in Run 4 of Example 1 while changing the peripheral speed ratio K between the drum and sleeve.

The evaluation results are shown in Table 2.

From the results shown in Table 2, it is seen that a good image can be obtained only when the requirement of $1.25d/x \leqq K \leqq 2dx$ is satisfied.

TABLE 2

1.25d/X = 1.54, 2d/X = 2.46

| K | 1.0 | 1.5 | 1.6 | 1.9 | 2.4 | 2.5 | 2.9 |
|---|---|---|---|---|---|---|---|
| ID of First Copy | 0.97 | 1.27 | 1.31 | 1.35 | 1.38 | 1.40 | 1.42 |
| Resolution (lines/mm) of Second Copy | | | | | | | |
| longitudinal direction | 3.6 | 3.6 | 3.2 | 3.2 | 2.8 | 2.8 | 2.5 |
| lateral direction | 3.6 | 3.2 | 3.2 | 2.8 | 2.8 | 2.5~2.8 | 2.5 |
| Image Quality | X | X | ○ | ○ | ○ | X | X |

EXAMPLE 3

By using a commercially available electrophotographic copying machine (Model DC-112C supplied by Mita) and a black toner for negative charging, having an average particle size of 11 μm, the copying operation was carried out under development conditions shown below while changing the physical properties (average particle size and saturation magnetization) of the magnetic carrier, and the image quality was evaluated.

DEVELOPMENT CONDITIONS

Cut brush length: 1.0 mm

Drum-sleeve distance: 1.1 mm

Sleeve: main pole position = +3.5°, main pole intensity = 800 G

Drum/sleeve peripheral speed ratio: 2.9

Surface potential: +700 V

Bias Voltage: +180 V

Developer: carrier = ferrite carrier having an electric resistance of $10^9\Omega$-cm, toner = toner for negative charging, having an average particle size of 11 um, the toner concentration being set so that the specific surface area ratio between the carrier and toner was 1/1

The results of the evaluation are shown in Table 3.

In the evaluation of the image quality, when ID (reflection density) of the first copy was at least 1.3 and the resolution of the second copy was at least 2.8 lines/mm in either the longitudinal direction or the lateral direction, the image quality was judged to be good and indicated by mark "O", and other case was indicated by mark "X".

From the results shown in Table 3, it is seen that in Runs 3 and 6 satisfying the requirement of $1.25d/x \leqq K \leqq 2d/x$, a good image quality can be obtained. It also is seen that if the development is carried out under such conditions that the peripheral speed ratio K is higher than 2d/x as in Runs 1, 2 and 4, the resolution is poor and if the peripheral speed K is lower than 1.25d/x as in Run 5, ID of the obtained copy is reduced.

TABLE 3

(K = 2.9)

| Run No. | 1 | 2 | 3 | 4 | 5 | 6 |
|---|---|---|---|---|---|---|
| Carrier | | | | | | |
| particle size (μm) | 40 | 40 | 80 | 80 | 130 | 130 |
| saturation magnetization (emu/g) | 40 | 65 | 40 | 65 | 40 | 65 |
| 1.25d/X | 1.25 | 0.77 | 2.5 | 1.54 | 4.06 | 2.5 |
| 2d/X | 2.0 | 1.23 | 4.0 | 2.46 | 6.5 | 4.0 |
| Image Characteristics | | | | | | |
| ID of first copy | 1.47 | 1.46 | 1.31 | 1.42 | 1.21 | 1.32 |
| resolution (lines/mm) of second copy | | | | | | |
| longitudinal direction | 2.5 | 2.5 | 3.2 | 2.5 | 3.2 | 3.6 |
| lateral direction | 2.5 | 2.2 | 2.8 | 2.5 | 3.6 | 2.8 |

TABLE 3-continued

| | (K = 2.9) | | | | | |
|---|---|---|---|---|---|---|
| Run No. | 1 | 2 | 3 | 4 | 5 | 6 |
| image quality | X | X | ○ | X | X | ○ |

EXAMPLE 4

The copying test was carried out under the same conditions as described in Example 3 by using the carrier used in Run 4 of Example 3 while changing the peripheral speed ratio K between the drum and sleeve.

The evaluation results are shown in Table 4.

From the results shown in Table 4, it is seen that a good image quality can be obtained only when the requirement of $1.25d/x \leqq K \leqq 2d/x$ is satisfied.

TABLE 4

| K | 1.0 | 1.5 | 1.6 | 1.9 | 2.4 | 2.5 | 2.9 |
|---|---|---|---|---|---|---|---|
| ID of First Copy | 0.97 | 1.27 | 1.31 | 1.35 | 1.38 | 1.40 | 1.42 |
| Resolution (lines/mm) of Second Copy | | | | | | | |
| longitudinal direction | 3.6 | 3.6 | 3.2 | 3.2 | 2.8 | 2.8 | 2.5 |
| lateral direction | 3.6 | 3.2 | 3.2 | 2.8 | 2.8 | 2.5 | 2.5 |
| Image Quality | X | X | ○ | ○ | ○ | X | X |

EXAMPLE 5

In each of Runs 1 through 6 of Example 3, the peak value P ($gf/cm^2$) of the developing pressure was measured according to the process disclosed in Japanese Patent Laid-Open Application No. 1-140178.

The relation between the peak value and the image quality is shown in Table 5.

TABLE 5

| Run No. | 1 | 2 | 3 | 4 | 5 | 6 |
|---|---|---|---|---|---|---|
| Peak Value ($gf/cm^2$) of Developing Pressure | 7.1 | 7.7 | 4.6 | 7.0 | 2.3 | 4.7 |
| Image Quality | X | X | ○ | X | X | ○ |

From the results shown in Table 5, it is seen that a good image is obtained when the developing pressure is within a certain range.

The formula (1) can be rewritten as $3.1 \leqq 2.5Kx/d \leqq 5.0$. Accordingly, it presumed that the developing pressure P ($gf/cm^2$) can be expressed by the function of the peripheral speed ratio K between the drum and sleeve and the average particle size d and saturation magnetization x of the magnetic carrier. Practically, if $P \equiv 2.5x/d$, the presumption is well in agreement with the experimental results shown in Table 5.

EXAMPLE 6

To 100 parts by weight of a toner for negative charging having average particle size of 11 μm was added 0.03 part by weight, per 100 parts by weight of the toner, of a fine powder of a PMMA polymer having a particle size of 0.5 μm, and the polymer particle was uniformly dispersed on the surfaces of the toner particles. Then, 0.03 part of hydrophobic silica having an average primary particle size of 0.03 μm was mixed in the above toner particles to obtain a toner composition (hereinafter referred to as "toner composition A"). A toner composition B was prepared by adding only 0.03 part of the fine powder of the PMMA polymer to the toner, a toner composition C was prepared by adding only 0.03 part by weight of the hydrophobic silica to the toner, and a toner composition D was prepared by adding 0.03 part by weight of aluminum oxide having a particle size of 0.02 μm and 0.03 part by weight of the hydrophobic silica to the toner.

By using the so-obtained toner compositions and the magnetic carrier used in Run 5 of Example 3 and adjusting the peripheral speed ratio K between the drum and sleeve to 5 ($1.2d/x=4.06$, $2d/x=6.5$), the copying test for obtaining 50,000 copies was carried out under the same development conditions as described in Example 3. The image quality was evaluated in the same manner as described in Example 3, and the number of copies in which the image quality was judged to be "O" was counted as the printable copy number.

The obtained results are shown in Table 6.

From the results shown in Table 6, it is seen that when the development is carried out by using a toner composition comprising a mixture of a fine powder of an acrylic polymer and a fine powder of silica, the copying property (printability) is drastically improved.

TABLE 6

| | Additive | Printable Copy Number |
|---|---|---|
| Toner Alone | not added | 10,000 |
| Composition A | acrylic polymer and silica | 50,000 |
| Composition B | acrylic polymer alone | 30,000 |
| Composition C | silica alone | 25,000 |
| Composition D | aluminum oxide and silica | 30,000 |

EXAMPLE 7

The copying test was carried out at a high temperature and a high relative humidity (35° C. and 85%) by using a toner composition formed by adding 0.04 part by weight, per 100 parts by weight of the toner, of the fine powder of the PMMA polymer while changing the amount added of the hydrophobic silica as shown in Table 7. The obtained results are shown in Table 7.

From the results shown in Table 7, it is seen that a toner composition formed by adding silica in an amount 1 to 5 times the amount of a fine powder of an acrylic polymer gives good results.

TABLE 7

| Run No. | Hydrophobic Silica (part by weight) | Acrylic Resin:Silica | Printable Copy Number |
|---|---|---|---|
| 1 | 0.02 | 1:0.5 | 30,000 |
| 2 | 0.04 | 1:1 | 40,000 |
| 3 | 0.16 | 1:4 | 50,000 |
| 4 | 0.20 | 1:5 | 45,000 |
| 5 | 0.30 | 1:7.5 | 25,000 |

EXAMPLE 8

By using a commercially available electrophotographic copying machine (Model DC-112C supplied by Mita) and a black toner for negative charging, having an average particle size of 11 μm, the copying operation was carried out under development conditions shown below while changing the physical properties (average particle size and saturation magnetization) of a magnetic carrier, and the image quality was evaluated.

DEVELOPMENT CONDITIONS

Cut brush length: 1.0 mm

Drum-sleeve distance: 1.1 mm

Sleeve: main pole position = +3.5°, main pole intensity = 800 G

Drum/sleeve peripheral speed ratio: 2.9

Surface potential + 700 V

Bias voltage: +180 V

Developer: carrier = ferrite carrier having an electric resistance of $10^9\Omega$-cm, toner = toner for negative charging, having an average particle size of 11 μm, the toner concentration being set so that the specific surface area ratio between the carrier and toner was 1/1

The results of the evaluation are shown in Table 8.

In the evaluation of the image quality, when ID (reflection density) of the first copy was at least 1.3 and the resolution of the second copy was at least 2.8 lines/mm in either the longitudinal direction or the lateral direction, the image quality was judged to be good and indicated by mark "O", and other case was indicated by mark "X".

From the results shown in Table 8, it is seen that in Runs 3 and 6 satisfying the requirement of $1.25d/x \leqq K \leqq 2d/x$, a good image quality can be obtained. It also is seen that if the development is carried out under such conditions that the peripheral speed ratio K is higher than 2d/x as in Runs 1, 2 and 4, the resolution is poor and if the peripheral speed ratio K is lower than 1.25d/x as in Run 5, ID of the obtained copy is low.

TABLE 8

| | (K = 2.9) | | | | | |
|---|---|---|---|---|---|---|
| Run No. | 1 | 2 | 3 | 4 | 5 | 6 |
| Carrier | | | | | | |
| particle size (μm) | 40 | 40 | 80 | 80 | 130 | 130 |
| saturation magnetization (emu/g) | 40 | 65 | 40 | 65 | 40 | 65 |
| 1.25d/X | 1.25 | 0.77 | 2.5 | 1.54 | 4.06 | 2.5 |
| 2d/X | 2.0 | 1.23 | 4.0 | 2.46 | 6.5 | 4.0 |
| Image Characteristics | 1.47 | 1.46 | 1.31 | 1.42 | 1.21 | 1.32 |
| ID of first copy | | | | | | |
| resolution (lines/mm) of second copy | | | | | | |
| longitudinal direction | 2.5 | 2.5 | 3.2 | 2.5 | 3.2 | 3.6 |
| lateral direction | 2.5 | 2.2 | 2.8 | 2.5 | 3.6 | 2.8 |
| image quality | X | X | ○ | X | X | ○ |

EXAMPLE 9

The copying test was carried out under the same development conditions as described in Example 8 by using the carrier used in Run 4 of Example 8 while changing the peripheral speed ratio K between the drum and sleeve.

The evaluation results are shown in Table 9.

From the results shown in Table 9, it is seen that a good image can be obtained only when the requirement of $1.25d/x \leqq K \leqq 2d/x$ is satisfied.

TABLE 9

| K | 1.0 | 1.5 | 1.6 | 1.9 | 2.4 | 2.5 | 2.9 |
|---|---|---|---|---|---|---|---|
| ID of First Copy | 0.97 | 1.27 | 1.31 | 1.35 | 1.38 | 1.40 | 1.42 |
| Resolution (lines/mm) of Second Copy | | | | | | | |
| longitudinal direction | 3.6 | 3.6 | 3.2 | 3.2 | 2.8 | 2.8 | 2.5 |
| lateral direction | 3.6 | 3.2 | 3.2 | 2.8 | 2.8 | 2.5 | 2.5 |
| Image Quality | X | X | ○ | ○ | ○ | X | X |

EXAMPLE 10

The copying test was carried out under the same development conditions as described in Example 8 by using the carrier used in Run 3 in Example 8 while changing the apparent density as shown in Table 10.

The image quality was evaluated in the same manner as described in Example 8, and the number of copies which the image quality was "O" was counted as the printable copy number.

The obtained results are shown in Table 10.

From the results shown in Table 10, it is seen that when a carrier A having an apparatus density of 2.4 to 3.0 g/cm³ is used, the copying property is drastically improved and good images can be obtained over a long period as compared with the case where a carrier B or C failing to satisfy the above requirement of the apparent density is used.

TABLE 10

| Carrier | Apparent Density (g/cm³) | ID of First Copy | Resolution (lines/mm) of Second Copy: longitudinal direction | Resolution (lines/mm) of Second Copy: lateral direction | Printable Copy Number |
|---|---|---|---|---|---|
| A | 2.67 | 1.35 | 3.6 | 3.2 | 30,000 |
| B | 2.35 | 1.31 | 2.8 | 2.8 | 20,000 |
| C | 3.10 | 1.43 | 2.8 | 2.8 | 20,000 |

EXAMPLE 11

By using a commercially available electrophotographic copying machine (Model DC-112C supplied by Mita) and a black toner for negative charging, having an average particle size of 11 μm, the copying operation was carried out under development conditions shown below while changing the physical properties (average particle size and saturation magnetization) of the magnetic carrier, and the image quality was evaluated.

DEVELOPMENT CONDITIONS

Cut brush length: 1.0 mm

Drum-sleeve distance: 1.1 mm

Sleeve: main pole position = +3.5°, main pole intensity = 800 G

Drum/sleeve peripheral speed ratio: 2.9

Surface potential: +700 V

Bias Voltage: +180 V

Developer: carrier = ferrite carrier having an electric resistance of $10^9\Omega$-cm, toner = toner for negative charging, having an average particle size of 11 μm, the toner concentration being set so that the specific surface area ratio between the carrier and toner was 1/1

The results of the evaluation are shown in Table 11.

In the evaluation of the image quality, when ID (reflection density) of the first copy was at least 1.3 and the resolution of the second copy was at least 2.8 lines/mm in either the longitudinal direction or the lateral direction, the image quality was judged to be good and indicated by mark "O", and other case was indicated by mark "X".

From the results shown in Table 11, it is seen that if the peripheral speed ratio K of the sleeve to the drum satisfies the requirement of 1.25d/x K 2d/x as in Runs 3 and 6, a good image can be obtained. It also is seen that if the peripheral speed ratio K is higher than 2d/x as in Runs 1, 2 and 4, the resolution is poor and if the peripheral speed ratio K is lower than 1.25d/x as in Run 5, ID of the obtained copy is low.

TABLE 11

| | (K = 2.9) | | | | | |
|---|---|---|---|---|---|---|
| Run No. | 1 | 2 | 3 | 4 | 5 | 6 |
| Carrier | | | | | | |
| particle size (μm) | 40 | 40 | 80 | 80 | 130 | 130 |
| saturation magnetization (emu/g) | 40 | 65 | 40 | 65 | 40 | 65 |
| 1.25d/X | 1.25 | 0.77 | 2.5 | 1.54 | 4.06 | 2.5 |
| 2d/X | 2.0 | 1.23 | 4.0 | 2.46 | 6.5 | 4.0 |
| Image Characteristics | 1.47 | 1.46 | 1.31 | 1.42 | 1.21 | 1.32 |
| ID of first copy | | | | | | |
| resolution (lines/mm) of second copy | | | | | | |
| longitudinal direction | 2.5 | 2.5 | 3.2 | 2.5 | 3.2 | 3.6 |
| lateral direction | 2.5 | 2.2 | 2.8 | 2.5 | 3.6 | 2.8 |
| image quality | X | X | ○ | X | X | ○ |

EXAMPLE 12

In the same manner as described in Example 11, the copying test was carried out by using the carrier used in Run 4 of Example 11 while changing the peripheral speed ratio K between the drum and sleeve.

The evaluation results are shown in Table 12.

From the results shown in Table 12, it is seen that good images can be obtained only when the requirement of $1.25d/x \leqq K \leqq 2d/x$ is satisfied.

TABLE 12

| K | 1.0 | 1.5 | 1.6 | 1.9 | 2.4 | 2.5 | 2.9 |
|---|---|---|---|---|---|---|---|
| ID of First Copy | 0.97 | 1.27 | 1.31 | 1.35 | 1.38 | 1.40 | 1.42 |
| Resolution (lines/mm) of Second Copy | | | | | | | |
| longitudinal direction | 3.6 | 3.6 | 3.2 | 3.2 | 2.8 | 2.8 | 2.5 |
| lateral direction | 3.6 | 3.2 | 3.2 | 2.8 | 2.8 | 2.5 | 2.5 |
| Image Quality | X | X | ○ | ○ | ○ | X | X |

EXAMPLE 13

The copying test was carried out under the same development conditions as described in Example 11 by using the carrier (having an average particle size of 80 μm) used in Run 3 in Example 11 while changing the particle size distribution. The image quality was evaluated in the same manner as described in Example 11.

The number of copies in which the image quality was judged to be "O" was counted as the printable copy number. The obtained results are shown in Table 13.

From the results shown in Table 13, it is seen that when the carrier A satisfying the requirement that the amount of particles having a particle size up to 0.5 time as large as the average particle size is smaller than 0.1% by weight and the amount of particles having a particle size 0.7 to 1.4 times as large as the average particle size is at least 90% by weight is used, the printable copy number is much increased over the printable copy numbers attained when the carriers B, C and D failing to satisfy this requirement of the particle size distribution are used, and copies having a good image quality can be stably obtained for a long time when the carrier A is used.

TABLE 13

| | (K = 2.9) | | | |
|---|---|---|---|---|
| Carrier | A | B | C | D |
| Particle Size distribution | | | | |
| Particles having size smaller than 40 μm (% by weight) | 0.02 | 0.02 | 0.10 | 0.12 |
| Particles having size of 56 to 112 μm (% by weight) | 96.3 | 80.0 | 92.2 | 81.3 |
| ID of First Copy | 1.32 | 1.30 | 1.33 | 1.32 |
| Resolution (lines/mm) of Second Copy | | | | |
| longitudinal direction | 3.2 | 3.2 | 2.8 | 2.8 |
| lateral direction | 2.8 | 2.8 | 2.8 | 2.8 |
| Printable Copy Number | 30,000 | 25,000 | 25,000 | 20,000 |

EXAMPLE 14

By using a commercially available electrophotographic copying machine (Model DC-112C supplied by Mita) and a block toner for negative charging, having an average particle size of 11 μm, the copying operation was carried out under development conditions shown below while changing the physical properties (average particle size and saturation magnetization) of the magnetic carrier, and the image quality was evaluated.

DEVELOPMENT CONDITIONS

Cut brush length: 1.0 mm

Drum-sleeve distance: 1.1 mm

Sleeve: main pole position = +3.5°, main pole intensity = 800 G

Drum/sleeve peripheral speed ratio: 2.9

Surface potential: +700 V

Bias voltage: +180 V

Developer: carrier = ferrite carrier having an electric resistance of $10^9\Omega$-cm, toner = toner for negative charging, having an average particle size of 11 μm, the toner concentration being set so that the specific surface area ratio between the carrier and toner was 1/1

The results of the evaluation are shown in Table 14.

In the evaluation of the image quality, when ID (reflection density) of the first copy was at least 1.3 and the resolution of the second copy was at least 2.8 lines/mm in either the longitudinal direction or the lateral direction, the image quality was judged to be good and indicated by mark "O", and other case was indicated by mark "X".

From the results shown in Table 14, it is seen that in Runs 3 and 6 satisfying the requirement of $1.25d/x \leqq K \leqq 2d/x$, a good image quality can be obtained. It also is seen that if the development is carried out under such conditions that the peripheral speed ratio K is higher than 2d/x as in Runs 1, 2 and 4, the resolution is poor and if the peripheral speed ratio K is lower than 1.25d/x as in Run 5, ID of the obtained copy is low.

TABLE 14

| Run No. | (K = 2.9) 1 | 2 | 3 | 4 | 5 | 6 |
|---|---|---|---|---|---|---|
| Carrier | | | | | | |
| particle size (μm) | 40 | 40 | 80 | 80 | 130 | 130 |
| saturation magnetization (emu/g) | 40 | 65 | 40 | 65 | 40 | 65 |
| 1.25d/X | 1.25 | 0.77 | 2.5 | 1.54 | 4.06 | 2.5 |
| 2d/X | 2.0 | 1.23 | 4.0 | 2.46 | 6.5 | 4.0 |
| Image Characteristics | 1.47 | 1.46 | 1.31 | 1.42 | 1.21 | 1.32 |
| ID of first copy | | | | | | |
| resolution (lines/mm) of second copy | | | | | | |
| longitudinal direction | 2.5 | 2.5 | 3.2 | 2.5 | 3.2 | 3.6 |
| lateral direction | 2.5 | 2.2 | 2.8 | 2.5 | 3.6 | 2.8 |
| image quality | X | X | ○ | X | X | ○ |

EXAMPLE 15

The copying test was carried out in the same manner as described in Example 14 by using the carrier used in Run 4 while changing the peripheral speed ratio K between the drum and sleeve.

The evaluation results are shown in Table 15.

From the results shown in Table 15, it is seen that a good image quality can be obtained only when the requirement of $1.25d/x \leqq k \leqq 2d/x$ is satisfied.

TABLE 15

| K | 1.0 | 1.5 | 1.6 | 1.9 | 2.4 | 2.5 | 2.9 |
|---|---|---|---|---|---|---|---|
| ID of First Copy | 0.97 | 1.27 | 1.31 | 1.35 | 1.38 | 1.40 | 1.42 |
| Resolution (lines/mm) of Second Copy | | | | | | | |
| longitudinal direction | 3.6 | 3.6 | 3.2 | 3.2 | 2.8 | 2.8 | 2.5 |
| lateral direction | 3.6 | 3.2 | 3.2 | 2.8 | 2.8 | 2.5 | 2.5 |
| Image Quality | X | X | ○ | ○ | ○ | X | X |

EXAMPLE 16

The copying test was carried out in the same manner as described in Example 14 except that a covered carrier formed by covering the surface of the carrier used in Run 3 of Example 14 with a resin under conditions A through F shown in Table 16 was used as the magnetic carrier.

The image quality was evaluated in the same manner as described in Example 14, and the number of copies where the image quality was judged to be "O" was counted as the printable copy number.

The obtained results are shown in Table 17.

From the results shown in Table 17, it is seen that when the resin-covered carriers A through E are used, the printable copy number is greatly increased and good images can be obtained for a long time, as compared with the case where the uncovered carrier F is used.

TABLE 16

| Carrier | Resin Used | Covering Amount (% by weight) |
|---|---|---|
| A | acrylic resin (BR-85 supplied by Mitsubishi Rayon) | 1.0 |
| B | silicone resin (KR-255 supplied by Shinetsu Kagaku Kogyo) | 1.5 |
| C | silicon resin + melamine resin | 1.5 |
| D | acrylic-modified silicon resin (TSR-171 supplied by Toshiba Silicone) | 1.0 |
| E | acrylic-modified silicone resin + melamine resin | 1.0 |
| F | not covered | — |

TABLE 17

| Carrier | ID of First Copy | (K = 2.9) Resolution (lines/mm) of Second Copy: longitudinal direction | lateral direction | Printable Copy Number |
|---|---|---|---|---|
| A | 1.40 | 3.2 | 2.8 | 30,000 |
| B | 1.37 | 3.6 | 3.2 | 30,000 |
| C | 1.38 | 3.2 | 3.2 | 40,000 |
| D | 1.41 | 3.2 | 2.8 | 40,000 |
| E | 1.39 | 3.6 | 3.2 | 60,000 |
| F | 1.31 | 3.2 | 2.8 | 20,000 |

We claim:

1. A magnetic brush development process in the electrophotography, which comprises supplying a two-component type developer comprising an electroscopic toner and a magnetic carrier onto a magnet sleeve to form a magnetic brush and bringing the magnetic brush into sliding contact with the surface of a photosensitive material drum on which an electrostatic latent image is formed, to effect development, wherein the development is carried out under such conditions that the peripheral speed ratio K of the magnet sleeve to the photosensitive material drum satisfies the following requirement:

$$\frac{1.25d}{x} \leqq K \leqq \frac{2d}{x}$$

wherein d represents the average particle size (μm) of the magnetic carrier of the developer, and x represents the saturation magnetization (emu/g) of the magnetic carrier of the developer.

2. A development process according to claim 1, wherein the two-component type developer comprises the toner and carrier at such a ratio that the specific surface area ratio of the carrier to the toner is from 1/0.7 to 1/1.3.

3. A development process according to claim 1, wherein the magnetic carrier has an average particle size of 20 to 200 μm and a saturation magnetization of 30 to 70 emu/g.

4. A development process according to claim 1, wherein the electroscopic toner is one formed by adding a fine powder of an acrylic polymer and a fine powder of silica to an electroscopic toner.

5. A development process according to claim 4, wherein the fine powder of the acrylic polymer has a primary particle size of 0.01 to 1 μm and the fine powder of silica has a primary particle size of 0.01 to 1 m.

6. A development process according to claim 4, wherein the fine powder of the acrylic polymer is present in an amount of 0.01 to 0.2 part by weight per 100 parts by weight of the electroscopic toner and the fine powder of silica is present in such an amount that the weight ratio of the fine powder of silica to the fine powder of the acrylic polymer is from 1/1 to 1/5.

7. A development process according to claim 1, wherein the magnetic carrier has an apparent density of 2.4 to 3.0 g/cm$^3$.

8. A development process according to claim 1, wherein the magnetic carrier has such a particle size distribution that the amount of particles having a particle size up to 0.5 time as large as the average particle size is smaller than 0.1% by weight based on the entire carrier and the amount of particles having a particle size 0.7 to 1.4 times as large as the average particle size is at least 90% by weight based on the entire carrier.

9. A development process according to claim 1, wherein the magnetic carrier is one covered with a resin.

10. A development process according to claim 9, wherein the covering resin is a composition comprising a melamine resin and a thermoplastic resin containing a hydroxyl group or an alkoxyl group.

11. A development process according to claim 9, wherein the covering resin is present in an amount of 0.1 to 10 parts by weight per 100 parts by weight of the core of the magnetic carrier.

* * * * *